US006135422A

United States Patent [19]

Thomas

[11] Patent Number: 6,135,422

[45] Date of Patent: Oct. 24, 2000

[54] PORTABLE VEHICULAR HYDRAULIC JACK

[76] Inventor: Christopher M. Thomas, 7503 Providence Rd. South, Waxhaw, N.C. 28173

[21] Appl. No.: 09/195,963

[22] Filed: Nov. 19, 1998

[51] Int. Cl.[7] ..... B66F 3/24

[52] U.S. Cl. ..... 254/423

[58] Field of Search ..... 254/1, 418, 423, 254/89 H, 93 H

[56] References Cited

U.S. PATENT DOCUMENTS

| | | | |
|---|---|---|---|
| 2,401,787 | 6/1946 | McClure | 254/423 |
| 4,150,813 | 4/1979 | Mena | 254/423 |
| 4,475,714 | 10/1984 | Heiskell et al. | 254/89 H |
| 5,219,429 | 6/1993 | Shelton | 254/423 |
| 5,722,641 | 3/1998 | Martin et al. | 254/423 |

*Primary Examiner*—Robert C. Watson

[57] ABSTRACT

A vehicular hydraulic jack system is provided including a jack assembly having a base with a hydraulic cylinder mounted thereon for raising the jack assembly upon the receipt of pressurized fluid and lowering the jack assembly upon the release of pressurized fluid. Also included is a hose having a first end coupled to a power steering pump of a vehicle for receiving pressurized fluid therefrom and a second end coupled to the hydraulic cylinder of the jack assembly for supplying pressurized fluid to the hydraulic cylinder of the jack assembly.

9 Claims, 2 Drawing Sheets

FIG. 3
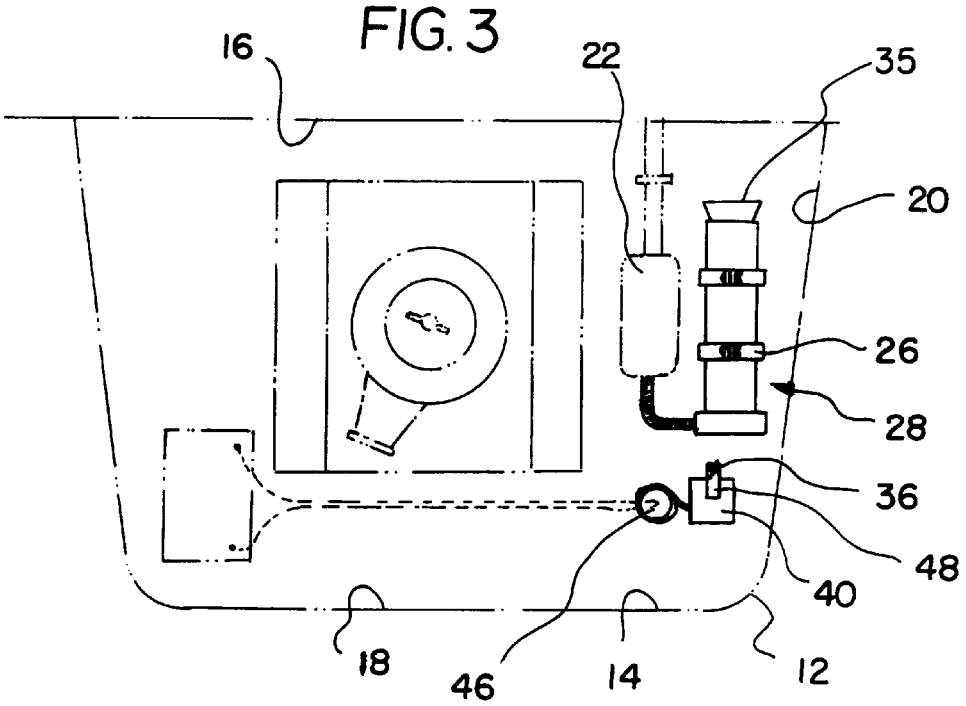
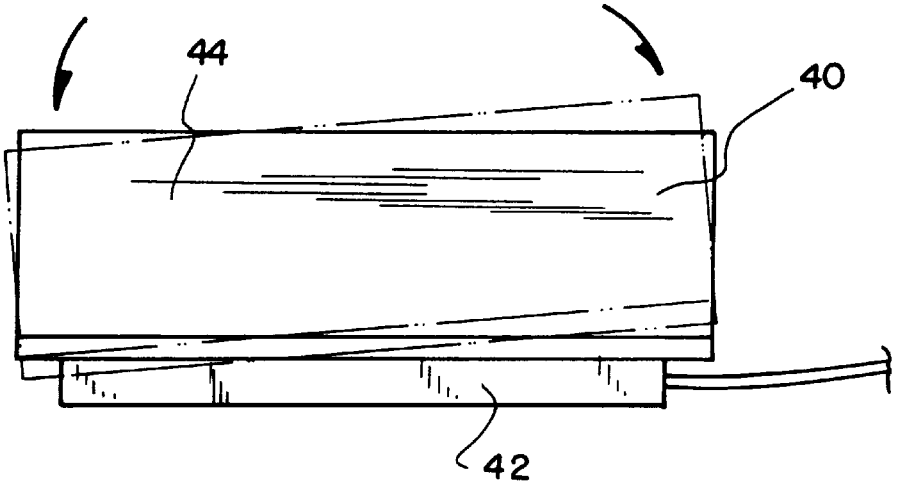
FIG. 4

PORTABLE VEHICULAR HYDRAULIC JACK

BACKGROUND OF THE INVENTION

1. Field of the Invention

The present invention relates to vehicular jacks and more particularly pertains to a new portable vehicular hydraulic jack for elevating a vehicle using pressurized power steering fluid for the purpose of repairing a tire or the like.

2. Description of the Prior Art

The use of vehicular jacks is known in the prior art. More specifically, vehicular jacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,844,535; U.S. Pat. No. 4,509,723; U.S. Pat. Des. 349,386; U.S. Pat. No. 3,806,091; U.S. Pat. No. 2,165,367; and U.S. Pat. No. 1,745,067.

In these respects, the portable vehicular hydraulic jack according to the present invention substantially departs from the conventional concepts and designs of the prior art, and in so doing provides an apparatus primarily developed for the purpose of elevating a vehicle using pressurized power steering fluid for the purpose of repairing a tire or the like.

SUMMARY OF THE INVENTION

In view of the foregoing disadvantages inherent in the known types of vehicular jacks now present in the prior art, the present invention provides a new portable vehicular hydraulic jack construction wherein the same can be utilized for elevating a vehicle using pressurized power steering fluid for the purpose of repairing a tire or the like.

The general purpose of the present invention, which will be described subsequently in greater detail, is to provide a new portable vehicular hydraulic jack apparatus and method which has many of the advantages of the vehicular jacks mentioned heretofore and many novel features that result in a new portable vehicular hydraulic jack which is not anticipated, rendered obvious, suggested, or even implied by any of the prior art vehicular jacks, either alone or in any combination thereof.

To attain this, the present invention generally comprises a vehicle having an engine compartment defined by a rear wall, a front wall, and a pair of side walls. The vehicle further includes a power steering pump for operating a steering assembly of the vehicle. As shown in FIG. 3, a pair of bracket strips each have a central extent thereof coupled to an inner surface of one of the side walls of the engine compartment. Ends of each bracket strip have couples to define a pair of horizontally oriented, coaxially aligned closed loops for reasons that will soon become apparent. Next provided is a jack assembly including a base with a substantially square configuration having a planar bottom face, a planar top face, and a thin periphery formed therebetween. As shown in FIG. 2, the jack assembly further includes a cylindrical lower sleeve mounted to the top face of the base and extending upwardly therefrom in perpendicular relationship therewith. A cylindrical upper shaft has a bottom end slidably mounted within the lower sleeve. In use, the upper shaft is transferable between a raised orientation upon the receipt of pressurized fluid within the lower sleeve and a lowered orientation upon the release of pressurized fluid from within the lower sleeve. The jack assembly further has a substantially inverted frusto-conical cup mounted on a top end of the upper shaft. When not in use, the lower sleeve of the jack assembly is adapted for being removably secured within the engine compartment via the closed loops of the bracket strips of the vehicle. Note FIG. 3. Also included is a 12 foot bellowed hose having a first end coupled to the power steering pump of the vehicle for receiving pressurized fluid therefrom. A second end of such hose is coupled to the base of the jack assembly and remains in communication with the lower sleeve thereof. Also included is a normally closed solenoid that is connected between the power steering pump and the lower sleeve of the jack assembly. In operation, the solenoid is adapted for allowing the passage of pressurized fluid between the power steering pump and the lower sleeve only upon the receipt of power. Finally, a control pedal includes a support plate and a rectangular pedal pivotally coupled to a central extent of the support plate. As shown in the Figures, the pedal is connected between a battery of the vehicle and the solenoid via an elongated wire. In use, the pedal has an unbiased orientation for precluding the flow of power to the solenoid. The pedal further has a biased orientation for allowing the flow of power to the solenoid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable vehicular hydraulic jack apparatus and method which has many of the advantages of the vehicular jacks mentioned heretofore and many novel features that result in a new portable vehicular hydraulic jack which is not anticipated, rendered obvious, suggested, or even implied by any of the prior art vehicular jacks, either alone or in any combination thereof.

It is another object of the present invention to provide a new portable vehicular hydraulic jack which may be easily and efficiently manufactured and marketed.

It is a further object of the present invention to provide a new portable vehicular hydraulic jack which is of a durable and reliable construction.

An even further object of the present invention is to provide a new portable vehicular hydraulic jack which is susceptible of a low cost of manufacture with regard to both materials and labor, and which accordingly is then susceptible of low prices of sale to the consuming public, thereby making such portable vehicular hydraulic jack economically available to the buying public.

Still yet another object of the present invention is to provide a new portable vehicular hydraulic jack which provides in the apparatuses and methods of the prior art some of the advantages thereof, while simultaneously overcoming some of the disadvantages normally associated therewith.

Still another object of the present invention is to provide a new portable vehicular hydraulic jack for elevating a vehicle using pressurized power steering fluid for the purpose of repairing a tire or the like.

Even still another object of the present invention is to provide a new portable vehicular hydraulic jack that includes a jack assembly having a base with a hydraulic cylinder mounted thereon for raising the jack assembly upon the receipt of pressurized fluid and lowering the jack assembly upon the release of pressurized fluid. Also included is a hose having a first end coupled to a power steering pump of a vehicle for receiving pressurized fluid therefrom and a second end coupled to the hydraulic cylinder of the jack assembly for supplying pressurized fluid to the hydraulic cylinder of the jack assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top view of the engine compartment of the present invention.

FIG. 4 is a side view of the control pedal of the present invention.

DESCRIPTION OF THE PREFERRED EMBODIMENT

Figure 2:
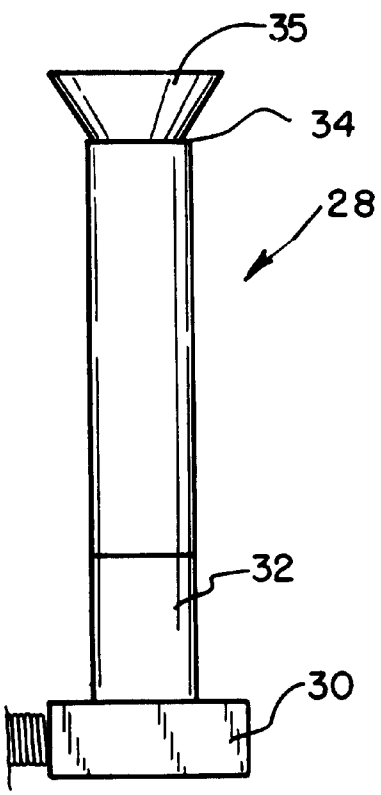
FIG. 2 is a side view of the jack assembly of the present invention.
Figure 1:
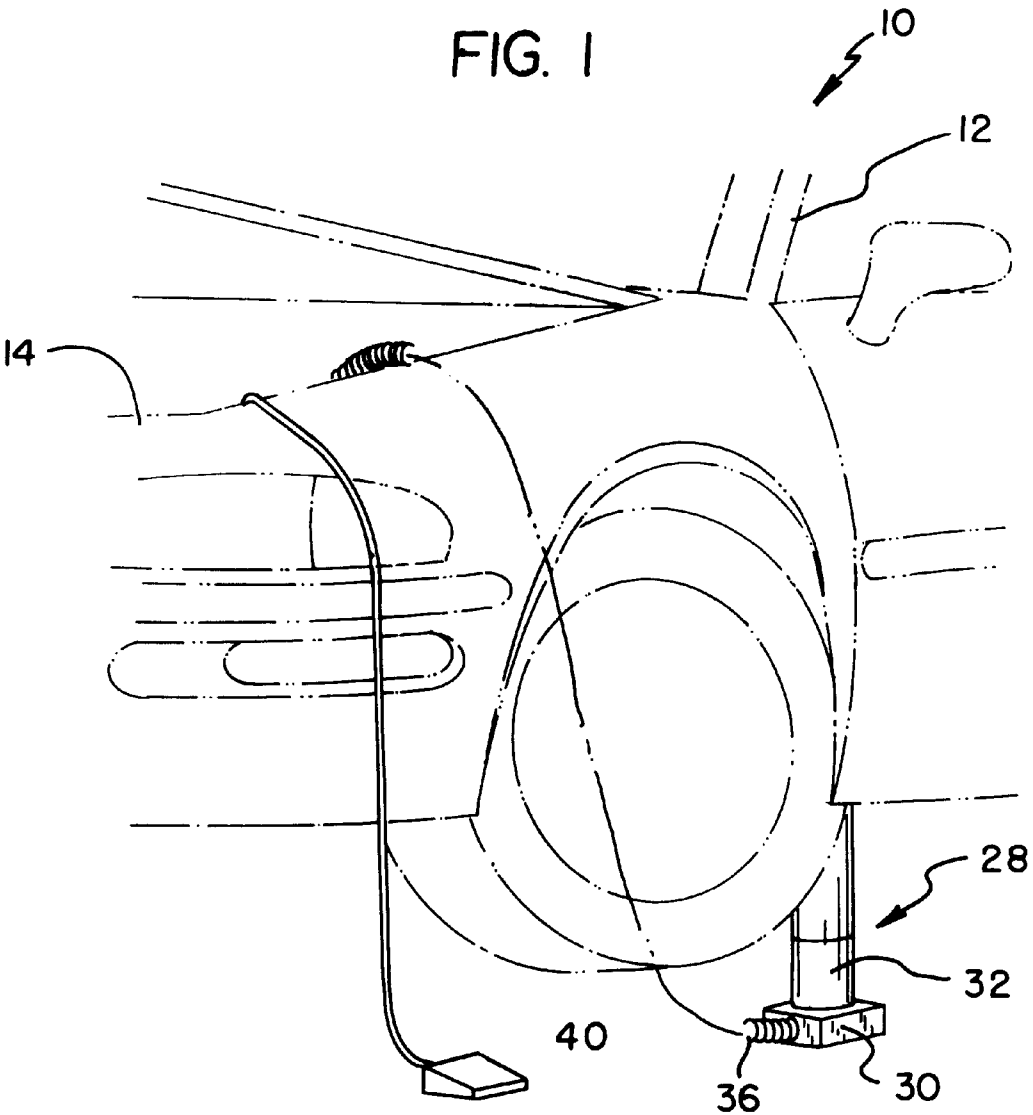
FIG. 1 is a perspective view of a new portable vehicular hydraulic jack system according to the present invention.

With reference now to the drawings, and in particular to FIGS. 1 through 4 thereof, a new portable vehicular hydraulic jack embodying the principles and concepts of the present invention and generally designated by the reference numeral 10 will be described.

The present invention, designated as numeral 10, includes a vehicle 12 having an engine compartment 14 defined by a rear wall 16, a front wall 18, and a pair of side walls 20. The vehicle further includes a power steering pump 22 for operating a steering assembly of the vehicle. As shown in FIG. 3, a pair of bracket strips 26 each have a central extent thereof coupled to an inner surface of one of the side walls of the engine compartment. Ends of each bracket strip have couples to define a pair of horizontally oriented, coaxially aligned closed loops for reasons that will soon become apparent. The aforementioned couples may comprise of buckles, clamps, or the like.

Next provided is a jack assembly 28 including a base 30 with a substantially square configuration having a planar bottom face, a planar top face, and a thin periphery formed therebetween. As shown in FIG. 2, the jack assembly further includes a cylindrical lower sleeve 32 mounted to the top face of the base and extending upwardly therefrom in perpendicular relationship therewith. A cylindrical upper shaft 34 has a bottom end slidably mounted within the lower sleeve. In use, the upper shaft is transferable between a raised orientation upon the receipt of pressurized fluid within the lower sleeve and a lowered orientation upon the release of pressurized fluid from within the lower sleeve.

The jack assembly further has a solid substantially inverted frusto-conical cup 35 mounted on a top end of the upper shaft. When not in use, the lower sleeve of the jack assembly is adapted for being removably secured within the engine compartment via the closed loops of the bracket strips. Note FIG. 3.

Also included is a 12-foot flexible bellowed hose 36 having a first end coupled to the power steering pump of the vehicle for receiving pressurized fluid therefrom. In the alternative, the first end of the hose may be coupled to a power steering fluid reservoir which is in turn connected to the power steering pump. A second end of such hose is coupled to the base of the jack assembly and remains in communication with the lower sleeve thereof.

Also included is a normally closed solenoid that is connected between the power steering pump and the lower sleeve of the jack assembly. It should be noted that the solenoid may be positioned within the base or adjacent to the pump during use. In operation, the solenoid is adapted for allowing the passage of pressurized fluid between the power steering pump and the lower sleeve only upon the receipt of power.

Finally, a control pedal 40 includes a support plate 42 and a rectangular pedal 44 pivotally coupled to a central extent of the support plate. The pedal is connected between a battery of the vehicle and the solenoid via an elongated wire. Ideally, the wire is rotatably mounted on a spindle 46 positioned within the engine compartment for dispensing purposes. As an option, a tie-down 48 is provided within the engine compartment for maintaining the control pedal secured therein when not in use.

In operation, the pedal has a level unbiased orientation for precluding the flow of power to the solenoid. The pedal further has a tilted biased orientation for allowing the flow of power to the solenoid. As such, the jack assembly may be positioned beneath the vehicle and the control pedal on a ground surface adjacent the vehicle when a flat tire is experienced. Thereafter, the vehicle is started, thereby actuating the power steering pump which makes pressurized fluid available. When desired, the control pedal is depressed which in turn raises the upper shaft of the hydraulic cylinder of the jack assembly. It should be noted that when the control pedal is not being depressed, the flow of fluid from the hydraulic cylinder is prevented by the normally closed nature of the solenoid for safety purposes. Finally, after the tire is repaired, the pump may be deactuated via the ignition of the vehicle after which the control pedal is again depressed for releasing the fluid within the hydraulic cylinder and lowering the same.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vehicular hydraulic jack system comprising, in combination:

a vehicle including an engine compartment defined by a rear wall, a front wall, and a pair of side walls, the vehicle further including a power steering pump for operating a steering assembly of the vehicle, the vehicle further including a pair of bracket strips each having a central extent thereof coupled to an inner surface of one of the side walls with a pair of ends having couples to define a pair of horizontally oriented, coaxially aligned closed loops;

a jack assembly including a base with a substantially square configuration having a planar bottom face, a planar top face, and a thin periphery formed therebetween, the jack assembly further including a cylindrical lower sleeve mounted to the top face of the base and extending upwardly therefrom in perpendicular relationship therewith, a cylindrical upper shaft having a bottom end slidably mounted within the lower sleeve between a raised orientation upon the receipt of pressurized fluid within the lower sleeve and a lowered orientation upon the release of pressurized fluid from within the lower sleeve, and a substantially inverted frusto-conical cup mounted on a top end of the upper shaft, wherein the lower sleeve of the jack assembly is adapted for being removably secured within the engine compartment via the closed loops of the bracket strips of the vehicle;

a 12 foot bellowed hose having a first end coupled to the power steering pump of the vehicle for receiving pressurized fluid therefrom and a second end coupled to the base of the jack assembly and in communication with the lower sleeve thereof;

a normally closed solenoid connected between the power steering pump and the lower sleeve of the jack assembly for allowing the passage of pressurized fluid between the power steering pump and the lower sleeve only upon the receipt of power; and a control pedal including a support plate and a rectangular pedal pivotally coupled to a central extent of the support plate, wherein the pedal is connected between a battery of the vehicle and the solenoid via an elongated wire and has an unbiased orientation for precluding the flow of power to the solenoid and a biased orientation for allowing the flow of power to the solenoid.

2. A vehicular hydraulic jack system comprising:

a vehicle including an engine compartment, the vehicle further including a power steering pump in the engine compartment for operating a steering assembly of the vehicle;

a jack assembly including a base with a hydraulic cylinder mounted thereon for raising the jack assembly upon the receipt of pressurized fluid and lowering the jack assembly upon the release of pressurized fluid, the jack assembly being freely movable between a stored position in the engine compartment of the vehicle and an employed position extending between a portion of the vehicle and a ground surface below the vehicle; and a hose having a first end in communication with a power steering pump of a vehicle for receiving pressurized fluid therefrom and a second end coupled to the hydraulic cylinder of the jack assembly for supplying pressurized fluid to the hydraulic cylinder of the jack assembly, wherein the hose permits movement of the jack assembly from the stored position in the engine compartment to the employed position.

3. A vehicular hydraulic jack system as set forth in claim 2 wherein the hose is bellowed.

4. A vehicular hydraulic jack system as set forth in claim 2 wherein a normally closed valve is connected between the pump and the hydraulic cylinder of the jack assembly for selectively allowing the passage of pressurized fluid between the power steering pump and the hydraulic cylinder of the jack assembly upon the actuation thereof.

5. A vehicular hydraulic jack system as set forth in claim 4 wherein the valve is connected to a control foot pedal via an elongated wire for actuating the valve only upon the depression thereof.

6. A vehicular hydraulic jack system as set forth in claim 2 and further including a pair of bracket strips mounted within an engine compartment of the vehicle, wherein the hydraulic cylinder of the jack assembly is adapted for being removably secured within the engine compartment via closed loops defined by the bracket strips of the vehicle.

7. A vehicular hydraulic jack system comprising:

a vehicle including an engine compartment, the vehicle further including a power steering pump in the engine compartment for operating a steering assembly of the vehicle;

a jack assembly freely movable between a stored position in the engine compartment of the vehicle and an employed position extending between a portion of the vehicle and a ground surface below the vehicle, the jack assembly including a base with a substantially planar bottom face, the jack assembly further including a lower sleeve mounted to the base and extending therefrom, an upper shaft having a bottom end slidably mounted in the lower sleeve, the upper shaft being movable between a raised orientation upon the receipt of pressurized fluid in the lower sleeve and a lowered orientation upon the release of pressurized fluid from in the lower sleeve, and a cup mounted on a top end of the upper shaft;

a hose having a first end coupled to the power steering pump of the vehicle for receiving pressurized fluid from the power steering pump and a second end coupled to the jack assembly and in communication with the lower sleeve thereof; and a normally closed solenoid connected between the power steering pump and the lower sleeve of the jack assembly for allowing the passage of pressurized fluid between the power steering pump and the lower sleeve upon the supplying of power to the solenoid.

8. The vehicular hydraulic jack system of claim 7 additionally comprising a control pedal including a support plate and a pedal pivotally coupled to the support plate, wherein the pedal is connected between a battery of the vehicle and the solenoid via an elongated wire and has an unbiased orientation for precluding the flow of power to the solenoid and a biased orientation for allowing the flow of power to the solenoid.

9. A vehicular hydraulic jack system as set forth in claim 2 wherein the hose is bellowed, wherein a normally closed valve is connected between the pump and the hydraulic cylinder of the jack assembly for selectively allowing the passage of pressurized fluid between the power steering pump and the hydraulic cylinder of the jack assembly upon the actuation thereof, wherein the valve is connected to a control foot pedal via an elongated wire for actuating the valve only upon the depression thereof, and further including a pair of bracket strips mounted within an engine compartment of the vehicle, wherein the hydraulic cylinder of the jack assembly is adapted for being removably secured within the engine compartment via closed loops defined by the bracket strips of the vehicle.

* * * * *